US009234488B2

(12) United States Patent
Gerstner

(10) Patent No.: US 9,234,488 B2
(45) Date of Patent: Jan. 12, 2016

(54) QUILL CONNECTOR FOR FUEL SYSTEM AND METHOD

(71) Applicant: Caterpillar, Inc., Peoria, IL (US)

(72) Inventor: Michael D. Gerstner, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 202 days.

(21) Appl. No.: 13/787,943

(22) Filed: Mar. 7, 2013

(65) Prior Publication Data

US 2014/0251277 A1 Sep. 11, 2014

(51) Int. Cl.

| | |
|---|---|
| ***F02M 69/04*** | (2006.01) |
| ***F02M 55/04*** | (2006.01) |
| *F02M 69/46* | (2006.01) |
| *F02M 55/02* | (2006.01) |

(52) U.S. Cl.

CPC ..... *F02M 69/04* (2013.01); *F02M 55/02* (2013.01); *F02M 55/04* (2013.01); *F02M 55/025* (2013.01); *F02M 69/465* (2013.01)

(58) Field of Classification Search

CPC ..... F02M 69/04; F02M 55/04; F02M 55/02
USPC ..... 123/457, 198 D, 198 DB, 456, 467, 468, 123/469, 470; 137/498, 517; 285/330, 345; 138/26–30
See application file for complete search history.

(56) References Cited

U.S. PATENT DOCUMENTS

| | | | | | |
|---|---|---|---|---|---|
| 2,150,524 | A * | 3/1939 | Starr | B21K 1/14 | 285/334.5 |
| 4,345,593 | A * | 8/1982 | Sullivan | A62B 7/04 | 128/204.26 |
| 5,813,432 | A * | 9/1998 | Elsdon | B60K 15/04 | 137/413 |
| 6,345,870 | B1 * | 2/2002 | Linkner, Jr. | B60T 8/367 | 251/129.02 |
| 6,374,802 | B1 * | 4/2002 | Boecking | F02M 47/027 | 123/198 DB |
| 6,443,180 | B1 * | 9/2002 | Samuelson | F16K 17/30 | 137/460 |
| 6,840,268 | B2 | 1/2005 | Kennedy et al. | | |
| 6,928,984 | B1 * | 8/2005 | Shamine | F02M 55/005 | 123/456 |
| 6,997,165 | B2 * | 2/2006 | Stockner | F02D 9/106 | 123/447 |
| 7,958,870 | B2 * | 6/2011 | Bonfigli | F02M 55/005 | 123/468 |
| 8,622,046 | B2 * | 1/2014 | Gerstner | F02M 55/004 | 123/447 |
| 9,038,601 | B2 * | 5/2015 | Morris | F02M 63/0215 | 123/198 D |
| 2005/0166899 | A1 * | 8/2005 | Shamine | F02M 55/005 | 123/456 |
| 2007/0284553 | A1 * | 12/2007 | Franconi | F16K 15/183 | 251/129.14 |
| 2011/0315117 | A1 | 12/2011 | Gerstner et al. | | |
| 2013/0104853 | A1 * | 5/2013 | Morris | F02M 63/0215 | 123/467 |
| 2013/0118451 | A1 * | 5/2013 | Morris | F02M 63/0215 | 123/445 |
| 2013/0119162 | A1 * | 5/2013 | Morris | F02M 63/0215 | 239/533.9 |
| 2013/0119166 | A1 * | 5/2013 | Morris | F02M 63/0215 | 239/580 |

* cited by examiner

*Primary Examiner* — Stephen K Cronin
*Assistant Examiner* — Kevin R Steckbauer

(57) ABSTRACT

A quill connector for a fuel system in an engine includes an elongate quill body defining a fuel conduit having a proximal accumulator segment, and a flow limiter subassembly, for limiting oversupplying of a pressurized fuel, positioned at least partially within the accumulator segment. The subassembly includes a seat component attached to the elongate quill body and supporting a guide component wherein a hydraulically actuated valve and a biaser are disposed. The valve is movable to a closed position during supplying pressurized fuel to a fuel injector, to interrupt a flow of the pressurized fuel thereto.

19 Claims, 3 Drawing Sheets

QUILL CONNECTOR FOR FUEL SYSTEM AND METHOD

TECHNICAL FIELD

The present disclosure relates generally to a quill connector for a fuel system in an internal combustion engine, and relates more particularly to interrupting a flow of pressurized fuel to a fuel injector via a flow limiter subassembly positioned at least partially within an accumulator in the quill connector.

BACKGROUND

Many modern internal combustion engine systems exploit the desirable combustion and emission properties attendant to high fuel injection pressures. It is well known that such high pressure fuel injection, often on the order of 200 megapascals (MPa) or more, promotes atomization and vaporization of injected fuel, having various desirable results. One strategy developed decades ago to enable the supplying of highly pressurized fuel to multiple fuel injectors in a multi-cylinder engine is known as a common rail. A common rail is essentially a long tube which serves to store a volume of highly pressurized fuel received from a fuel pump, and configured to feed the highly pressurized fuel simultaneously to a group of fuel injectors on the engine as needed. While common rail designs have worked very well over the years, and are still in widespread use, they present certain manufacturing, packaging, and pressure containment and sealing challenges. Some of these issues have been exacerbated by the drive towards ever higher fuel pressures.

Strategies have been proposed where a dedicated pressure accumulator is provided in direct connection with each fuel injector in an engine system. The dedicated pressure accumulators store a volume of fuel sufficient to enable stable provision of the fuel at design pressures for injection by the fuel injectors, and can in at least certain instances be easier to package and less expensive to manufacture and maintain than certain common rail designs. United States Patent Application Publication No. 2011/0315117 A1 to Gerstner et al. is directed to one such dedicated accumulator strategy. In Gerstner et al., a plurality of pressure accumulators are provided, each connected with one fuel injector, and a plurality of flow limiters are positioned fluidly between the pressure accumulators and the corresponding fuel injectors, apparently to limit fuel leakage during catastrophic failure and/or to dampen pressure oscillations caused by operation of the fuel injectors. While Gerstner et al. provides a viable strategy, there is always room for improvement.

SUMMARY

In one aspect, a quill connector for a fuel system in an internal combustion engine includes an elongate quill body defining a longitudinal axis extending between a proximal body end having a fuel inlet formed therein, and a distal body end having a fuel outlet formed therein. The elongate quill body further defines a fuel conduit fluidly connecting the fuel inlet with the fuel outlet. The fuel conduit includes a proximal accumulator segment having a greater volume, for containing a reserve of a pressurized fuel, and a distal injector supply segment having a lesser volume, for supplying the pressurized fuel to a fuel injector. The quill connector further includes a flow limiter subassembly for limiting oversupplying of the pressurized fuel, and including a guide component positioned within the accumulator segment, a seat component attached to the elongate quill body and supporting the guide component, and a hydraulically actuated valve and a biaser each positioned within the guide component. The biaser is held in compression between the valve and the seat component. The valve is movable in opposition to a biasing force of the biaser from a first position to a closed position at which the valve contacts the seat component to interrupt a flow of the pressurized fuel from the accumulator segment to the injector supply segment.

In another aspect, a fuel system for an internal combustion engine includes a supply of pressurized fuel, a fuel feed line in fluid communication with the supply of pressurized fuel, and a fuel injector. The fuel injector defines a high pressure fuel inlet, and a nozzle outlet, and has an injection valve movable between a first position at which the injection valve blocks the nozzle outlet from the high pressure fuel inlet, and a second position at which the nozzle outlet is open. The fuel system further includes a quill connector including a proximal end having a quill inlet formed therein and in fluid communication with the fuel feed line, and a distal end having a quill outlet formed therein. The distal end is in sealing engagement with the fuel injector, such that the quill outlet is in fluid communication with the high pressure fuel inlet. The quill connector defines a fuel conduit fluidly connecting the quill inlet with the quill outlet, the fuel conduit including a proximal accumulator segment having a greater volume, and a distal injector supply segment having a lesser volume. The quill connector further includes a flow limiter subassembly including a guide component, a seat component supporting the guide component within the accumulator segment, and a hydraulically actuated valve and a biaser each positioned within the guide component. The biaser is held in compression between the valve and the seat component, and the valve is movable in opposition to a biasing force of the biaser from a first position to a closed position at which the valve contacts the seat component to interrupt a flow of the pressurized fuel from the quill connector to the fuel injector.

In still another aspect, a method of limiting oversupplying a pressurized fuel from a quill connector to a fuel injector in an internal combustion engine includes conveying a pressurized fuel from a greater volume accumulator segment to a lesser volume injector supply segment of a fuel conduit in the quill connector. The method further includes supplying the pressurized fuel from the injector supply segment to the fuel injector, and hydraulically actuating a valve in a flow limiter subassembly of the quill connector during the supplying of the pressurized fuel, such that the valve moves toward a closed position contacting a seat component of the flow limiter subassembly. The method further includes guiding the valve during the actuation within a guide component of the flow limiter subassembly supported within the accumulator segment via the seat component, and blocking fluid communication between the accumulator segment and the injector supply segment via contacting the valve with the seat component at the closed position, such that the supplying of the pressurized fuel to the fuel injector is interrupted.

DETAILED DESCRIPTION

Figure 1:
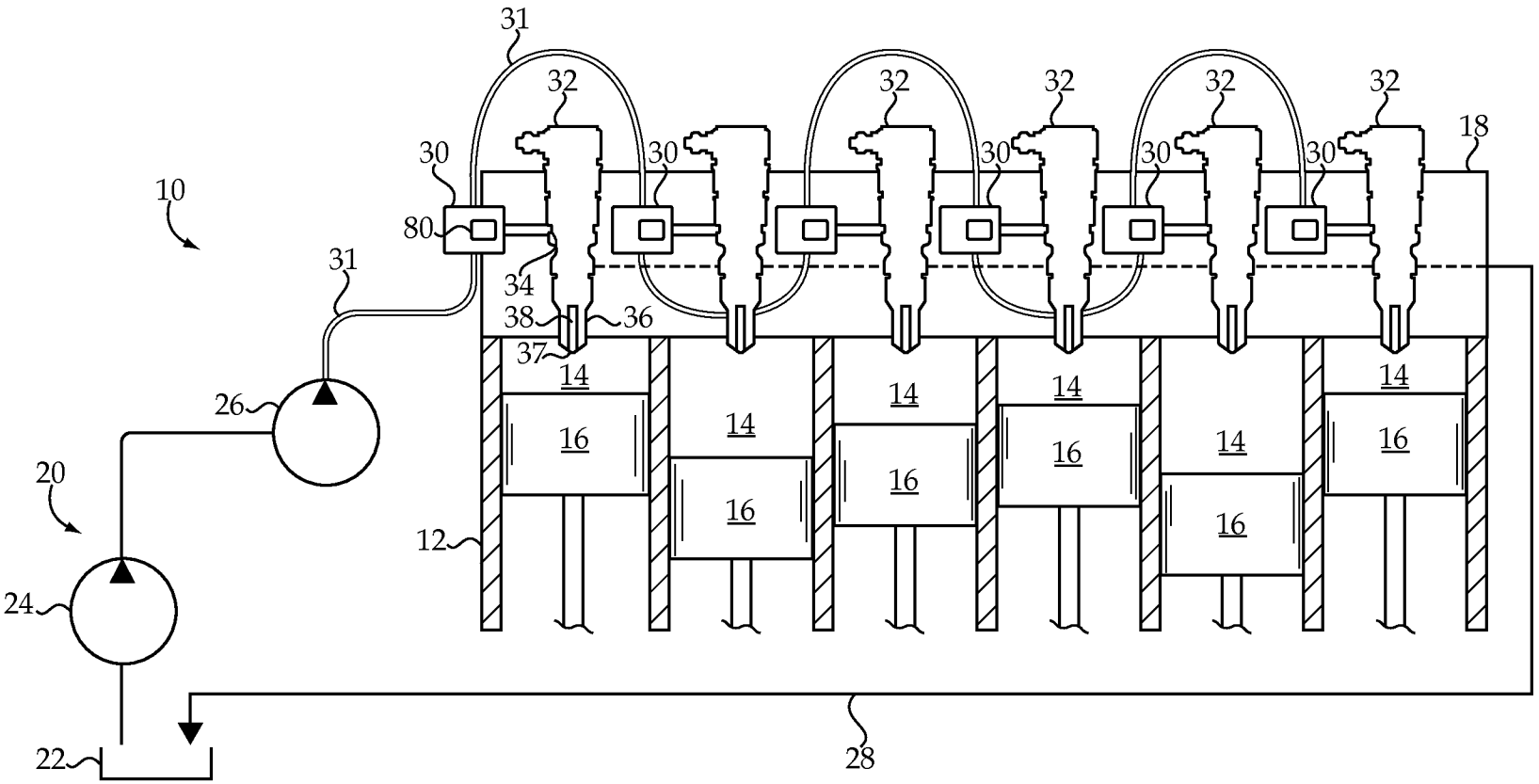
FIG. 1 is a side diagrammatic view of an engine having a fuel system, according to one embodiment.

Referring to FIG. 1, there is shown an internal combustion engine 10 such as a direct injection compression ignition diesel engine. Engine 10 includes an engine housing 12 having a plurality of cylinders 14 formed therein. Engine 10 further includes a plurality of pistons 16 reciprocable within each of cylinders 14 in a conventional manner, and configured to increase a fluid pressure within a corresponding cylinder 14 to an autoignition threshold. A cylinder head 18 is coupled to engine housing 12, and might include a plurality of separate cylinder head sections, each corresponding to one of cylinders 14. Engine 10 further includes a fuel system 20 having a fuel tank 22, and a low pressure fuel transfer pump 24 configured to transfer a fuel from tank 22 to a high pressure pump 26. Pump 26 pressurizes the fuel and conveys it to a plurality of fuel injectors 32 each mounted within cylinder head 18, and extending partially into one of cylinders 14. Fuel system 20 may further include a plurality of fuel feed lines 31 which convey the pressurized fuel from pump 26 to a plurality of quill connectors 30 each configured to supply the pressurized fuel to one of fuel injectors 32. In a practical implementation strategy, quill connectors 30 are positioned in series such that the pressurized fuel is conveyed from one quill connector to another to supply each of fuel injectors 32, in a generally known manner. A low pressure drain 28 may be in fluid communication with each of fuel injectors 32, and fluidly connects back to tank 22. As will be further apparent from the following description, fuel system 20 is uniquely configured to provide an accumulator volume within each of quill connectors 30, for storing a reserve of the pressurized fuel, and further for limiting oversupplying of the pressurized fuel to fuel injectors 32, particularly in the case of fuel injector or engine performance degradation or failure.

Each of fuel injectors 32 may further include a high pressure fuel inlet 34 in fluid communication with the corresponding quill connector, and a nozzle 36 receiving the pressurized fuel from the corresponding quill connector 30. Each fuel injector 32 may further include a nozzle outlet 37, and an injection valve 38 positioned at least partially within nozzle 36 and movable between a first position at which injection valve 38 blocks nozzle outlet 37 from high pressure fuel inlet 34, and a second position at which nozzle outlet 37 is open and not blocked by injection valve 38. It will be appreciated that reference numerals identifying features on one of fuel injectors 32 in FIG. 1 will be understood to refer analogously to similar or identical features on each of the other fuel injectors 32. In a like manner, quill connectors 30 may each be substantially identical.

Figure 2:
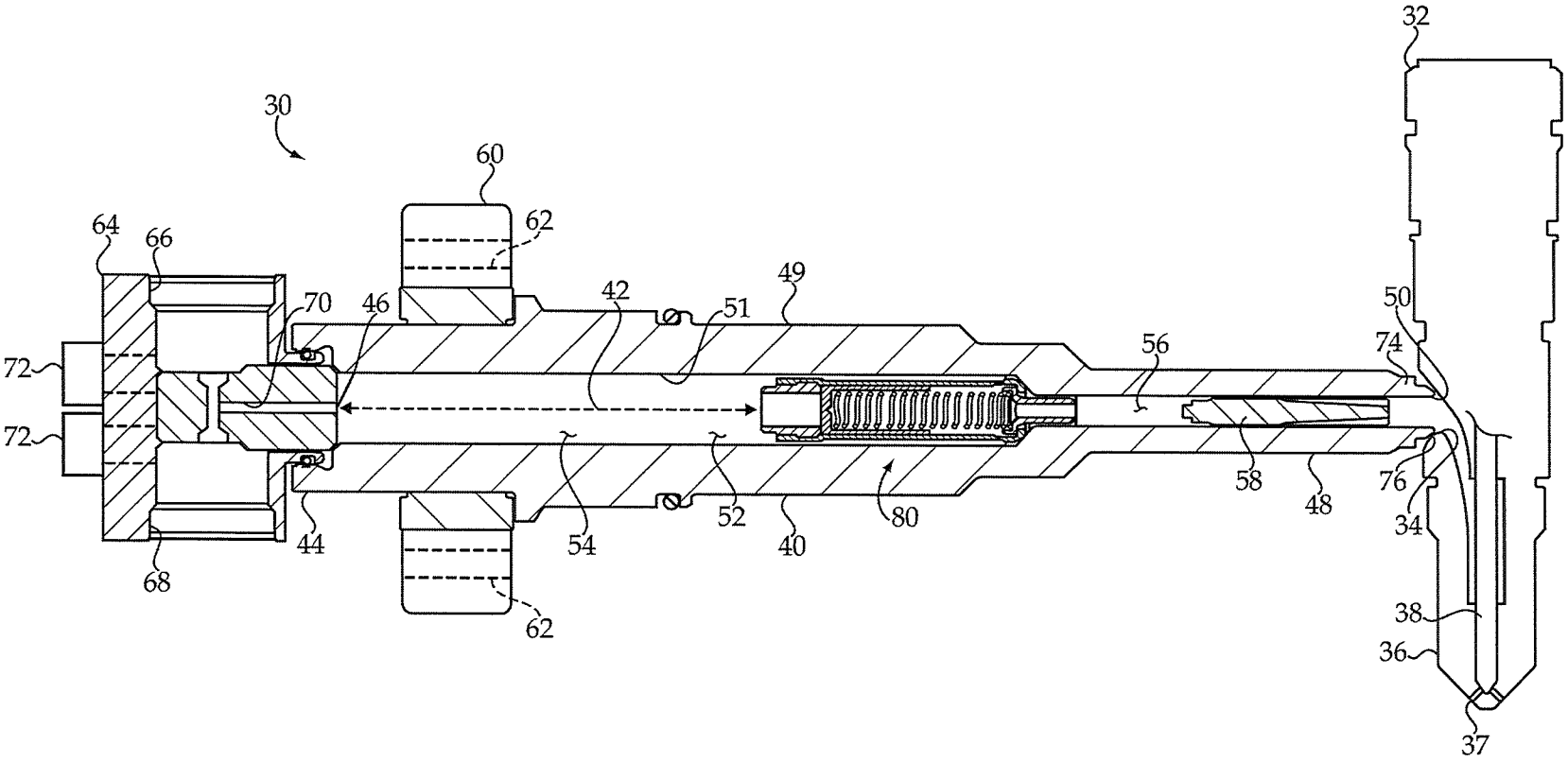
FIG. 2 is a sectioned side diagrammatic view of a quill connector, and a fuel injector, according to one embodiment.

Referring also now to FIG. 2, there is shown a quill connector 30 and one of fuel injectors 32. Quill connector 30 may include an elongate quill body 40 defining a longitudinal axis 42 extending between a proximal body end 44 having a fuel inlet 46 or "quill inlet" formed therein, and a distal body end 48 having a fuel outlet or "quill outlet" 50 formed therein. Quill body 40 may further include an outer surface 49, and an inner surface 51 defining a fuel conduit 52 fluidly connecting quill inlet 46 with quill outlet 50. Quill inlet 46 may be in fluid communication with one of fuel feed lines 31 for receiving pressurized fuel from high pressure pump 26. In a practical implementation strategy, distal end 48 may be in sealing engagement with fuel injector 32, such that quill outlet 50 is in fluid communication with high pressure fuel inlet 34. Distal end 48 may further include a distal tip 74 having a sealing surface 76 extending circumferentially around quill outlet 50. In a practical implementation strategy, sealing surface 76 may be spherical.

Quill connector 30 may further include a clamp 60 positioned upon outer surface 49 and defining a plurality of bores 62 each configured to receive a bolt for clamping quill connector 30 to cylinder head 18, and further being configured to clamp distal tip 74 against fuel injector 32 such that sealing surface 76 forms a fluid seal therewith. An inlet body 64 is also coupled to proximal end 44, and in a practical implementation strategy includes a plurality of bolts 72 extending through bores in inlet body 64 to clamp inlet body into engagement with quill body 40. In the FIG. 2 illustration, bolts 72 will be understood to be received in proximal end 44, but are not visible in the selected section plane. Inlet body 64 further defines a first inlet/outlet or inlet/outlet passage 66 configured to fluidly connect with a first one of fuel feed lines 31, and a second inlet/outlet or inlet/outlet passage 68 configured to fluidly connect with a second one of fuel feed lines 31. Inlet body 64 thus can fluidly supply one quill connector with pressurized fuel, while also conveying the pressurized fuel to another quill connector. Where only one fuel feed line is connected to a quill connector in the present disclosure, such as where the quill connector forms the last link in a so-called daisy chain fuel system architecture, one of inlet/outlets 66 and 68 could be plugged. Inlet body 64 further defines an inlet passage 70 fluidly connecting with fuel conduit 52.

As noted above, fuel conduit 52 may fluidly connect quill inlet 46 with quill outlet 50. Fuel conduit 52 may further include a proximal accumulator segment 54 having a greater volume, for containing a reserve of a pressurized fuel, and a distal injector supply segment 56 having a lesser volume, for supplying the pressurized fuel to a fuel injector. Accumulator segment 54 may be configured to store a reserve of pressurized fuel received from high pressure pump 26 via one of feed lines 31 which is many times a volume of the largest fuel injection which is expected to be performed by fuel injector 32. In certain embodiments, a volume of proximal accumulator segment 54 may be about thirty times a volume of the largest expected fuel injection. Providing an accumulation volume in this general manner enables sufficient pressurized fuel to be consistently available for fuel injection, and can serve to attenuate or negate pressure waves, pulses, and other hydraulic phenomena arising out of the actuation of multiple additional fuel injectors and other components in fuel system 20 affecting fuel supply pressure. An inner diameter dimension of accumulator segment 54 may be greater than an inner diameter dimension of segment 56, for instance about two, three, four, or more times greater. An inner diameter dimension of fuel feed lines 31 may be less than the inner diameter dimension of segment 54.

Figure 3:
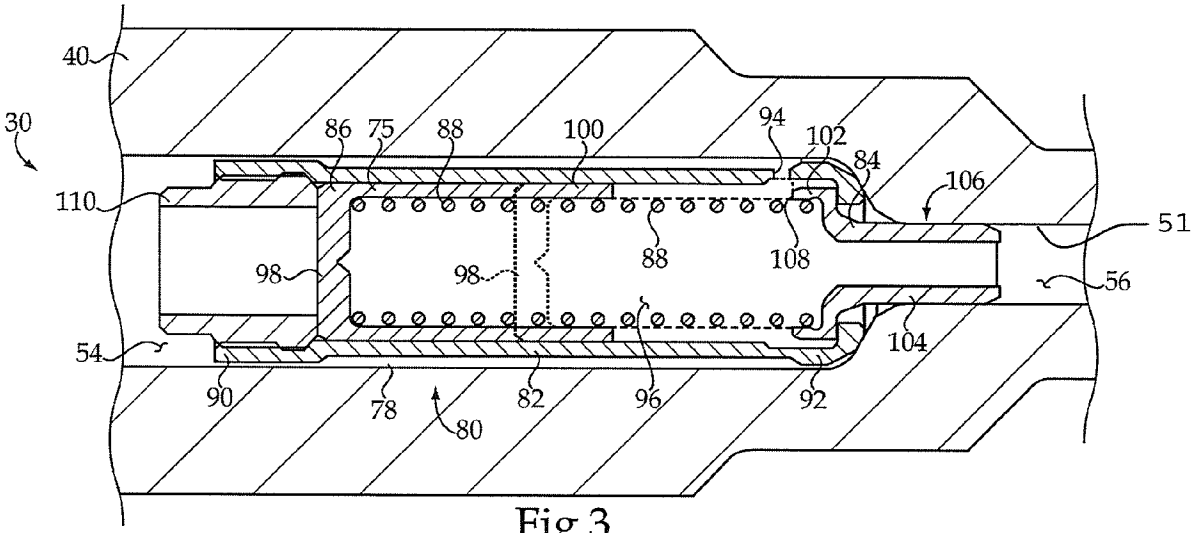
FIG. 3 is a sectioned side diagrammatic view of a portion of the quill connector of FIG. 2.

Referring also now to FIG. 3, quill connector 30 may further include a flow limiter subassembly 80 for limiting oversupplying of the pressurized fuel, and including a guide component 82 positioned within accumulator segment 54, and a seat component 84 attached to quill body 40 and supporting guide component 82. Flow limiter subassembly 80 may further include a hydraulically actuated valve 86 and a biaser 88 each positioned within guide component 82. Biaser 88 may include a helical biasing spring, held in compression between valve 86 and seat component 84. Valve 86 may be movable in opposition to a biasing force of biaser 88 from an open position, approximately as shown in FIGS. 2 and 3, to a closed position approximately as shown in phantom in FIG. 3, at which valve 86 contacts seat component 84 to interrupt a flow of the pressurized fuel from accumulator segment 54 to injector supply segment 56.

In a practical implementation strategy, guide component 82 may have the form of a guide sleeve coaxial with quill body 40. A clearance 78 may extend radially between guide component 82 and quill body 40, in particular between guide component 82 and inner surface 51. Guide component 82 may further define a reset orifice 94 in fluid communication with clearance 78, and reset orifice 94 may have a flow area less than a minimum flow area of clearance 78. Subassembly 80 may define a cavity 96 which refills with pressurized fuel supplied via clearance 78 and orifice 94 in a manner discussed further herein.

Valve 86 may be movable in a distal direction from its open position to its closed position. Subassembly 80 may further include a stop component 110 coupled to a proximal guide end 90 of guide component 82 and limiting travel of valve 86 in a proximal direction past its first position. In a practical implementation strategy, stop component 110 may include a nut threadedly engaged with guide component 82. It may further be noted from FIG. 3 that valve 86 may include a cup-shaped valve body 75 having a substantially circular base 98 coaxial with quill body 40. A substantially cylindrical skirt 100 extends from base 98 in a distal direction within guide component 82. Biaser 88 is positioned partially within skirt 100 and contacts each of base 98 and seat component 84.

As noted above, seat component 84 may be attached to quill body 40 and supports guide component 82. In a practical implementation strategy, seat component 84 includes a head 102, which may be generally cup-shaped and positioned in opposition to valve 86, such that the cup-shapes of the respective components open toward one another. Seat component 84 may further include a hollow neck 104 extending in an distal direction from head 102 into injector supply segment 56 and interference fitted with quill body 40 therein. In other words, neck 104 may be interference fitted with inner surface 51 of quill body 40 to form a press fit attachment 106 therewith. As noted above, seat component 84 may be understood to support guide component 82, within accumulator segment 54, and in particular may support guide component 82 against axial displacement. Seat component 84 may further support guide component 82 via holding it in abutment against quill body 40 such that tilting out of desired coaxial alignment is prevented. Head 102 may further include a valve seating surface 108, which includes an annular seating surface, contacted by valve 86 at its closed position. An edge filter 58 may be positioned within injector supply segment 56 between neck 104 and quill outlet 50 as shown in FIG. 2. Edge filter 58 may be any suitable type, including the type taught in Gerstner et al. discussed above.

Figure 4:
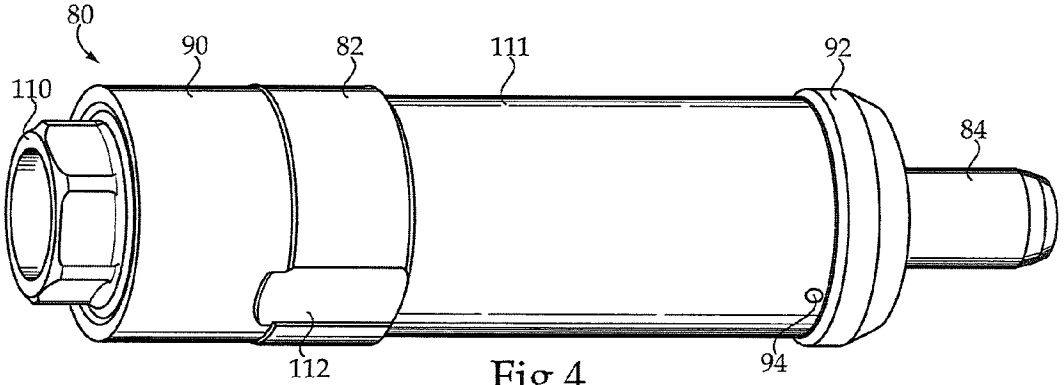
FIG. 4 is an isometric view of a flow limiter subassembly, according to one embodiment.

Referring now to FIG. 4, there is shown a view of subassembly 80 in an assembled configuration as it might appear prior to installation within quill body 40. In a practical implementation strategy, an outer diameter dimension of guide component 82 may be relatively greater at distal end 92, medium at proximal end 90, and relatively lesser between proximal and distal ends 90 and 92 as shown in FIG. 4. Another way to understand this feature is that guide component 82 may have a stepped-in profile defined by an outer surface 111 thereof, such that clearance 78 has a relatively greater volume in the part of guide component 82 that includes reset orifice 94. This feature can help ensure that sufficient flow area is available to feed reset orifice 94 for purposes of resetting valve 86 as discussed in more detail herein. Outer surface 111 may further include a plurality of flats 112, one of which is shown in FIG. 4 and the other of which is not visible, which can be used to securely hold guide component 82 with an assembly tool while stop component 110 is being engaged therewith to compress biaser 88 and complete assembly.

In contrast to certain known flow limiter designs, flow limiter subassembly 80 is positioned directly within an accumulated volume, and can be manufactured and assembled as a separate component, which can then be installed within quill body 40. In a practical implementation strategy, one technique for installing subassembly 80 includes sliding subassembly 80 in a distal direction through quill body 40, up to a point at which neck 104 begins to be received within injector supply segment 56. At this point, an elongate tool can be passed through stop component 110, and into engagement with valve 86. Valve 86 is then pushed in opposition to a biasing force of biaser 88, until skirt 100 contacts seating surface 108. Valve 86 can then be used to transmit a press fit force from the elongate tool to seat component 84, and press neck 104 into injector supply segment 56 to form press fit attachment 106. It is contemplated that press fit attachment 106 will form a sufficiently fluidly tight seal to prevent any substantial leakage of pressurized fuel from accumulator segment 54 into injector supply segment 56 when valve 86 is in its closed position, with skirt 100 sealing against valve seating surface 108. A generally unobstructed flow of highly pressurized fuel into accumulator segment 54 can hold valve 86 in sealing engagement against seat portion 84 where downstream fluid pressure remains low, such as might occur in the case of fuel injector performance degradation or failure.

Industrial Applicability

Referring to the drawings generally, during operation of fuel system 20, high pressure pump 26 will continuously or at regular pumping strokes supply pressurized fuel to quill connectors 30, which in turn convey the pressurized fuel from accumulator segment 54 to injector supply segment 56 within each quill connector 30, depending upon a pressure drop from segment 54 to segment 56, in turn induced by actuation of injection valve 38 in the corresponding fuel injector 32. The pressurized fuel can thus be supplied on an as-needed basis from segment 56 to the fuel injector 32.

During the flow of pressurized fuel from segment 54 to segment 56, valve 86 may be hydraulically actuated such that valve 86 moves from its first, retracted position toward its closed advanced position contacting seat component 84. Valve 86 may be guided during the actuation within guide component 82. During normal, non-problematic operation of fuel system 20, a fuel injection will typically terminate via closing of injection valve 38 prior to a time at which valve 86 contacts seat component 84. As a result, a pressure of fuel in segment 54 and segment 56 may begin to equalize. Clearance 78 and reset orifice 94 provide a flow path for pressurized fuel to refill cavity 96, such that hydraulic pressure and hydraulic force on a distal side of valve 86 versus a proximal side of valve 86 are substantially equal. With the hydraulic pressures equalized, a biasing force of biaser 88 can act to return valve 86 to its first position, abutting stop component 110. In a practical implementation strategy, sizing of surfaces of valve 86 exposed to pressurized fuel, as well as a spring force of biaser 88, may be tailored to enable this general functionality. It should be appreciated, however, that hydraulic surfaces on valve 86 might be sized such that valve 86 is hydraulically biased one direction or the other, depending upon the particular application. Likewise, a stiffness or relative compression of biaser 88 might be tailored for various purposes. It should be appreciated that if biaser 88 has too weak a biasing force exerted on valve 86, then valve 86 could be expected in some instances to "rachet" towards a closed position in response to repeated fuel injection cycles. If the biasing force is too strong, valve 86 might not be capable of moving to its fully closed position contacting seat component 84 when needed. Still other factors such as travel distance of valve 86, axial length of skirt 100, and even depth of axial penetration of stop component 110 into guide component 82 can all bear on proper operation of subassembly 80.

In a further practical implementation strategy, subassembly 80 may be configured such that valve 86 moves to its closed position and blocks fluid communication between segment 54 and segment 56, thus interrupting fuel injection, when a quantity of pressurized fuel has been supplied to the corresponding fuel injector 32 which is equal to about 1.5 times a maximum fuel injection amount fuel injector 32 is designed to deliver. As discussed above, subassembly 80, and valve 86, may be reset via conveying pressurized fuel to a distal side of valve 86 via reset orifice 94. In the case of catastrophic fuel injector failure, it is contemplated that valve 86 may remain held in its closed position, and no such resetting would occur, at least in some instances. Where the fuel injector is merely degraded in performance, and still capable of injecting fuel, at least partial resetting may occur to enable continued operation, with enough pressurized fuel making its way to a distal side of valve 86 to allow biaser 88 to move valve 86 off seat component 84 and continue operating until servicing, but providing protection against the oversupplying of fuel that might otherwise occur.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims.

What is claimed is:

1. A quill connector for a fuel system in an internal combustion engine, the quill connector comprising:

an elongate quill body defining a longitudinal axis extending between a proximal body end having a fuel inlet formed therein, and a distal body end having a fuel outlet formed therein;

the elongate quill body further defining a fuel conduit fluidly connecting the fuel inlet with the fuel outlet, and the fuel conduit including a proximal accumulator segment for containing a reserve of a pressurized fuel, and a distal injector supply segment for supplying the pressurized fuel to a fuel injector, a volume of the proximal accumulator segment being greater than a volume of the distal injector supply segment;

a flow limiter subassembly for limiting oversupplying of the pressurized fuel, the flow limiter subassembly including a guide component positioned within the proximal accumulator segment, a seat component including a head captive within the guide component and a neck extending in a distal direction from the head into the distal injector supply segment, wherein the seat component is attached to the elongate quill body and supporting the guide component in fixed relation to the elongate quill body along the longitudinal axis and wherein a distal end of the guide component is disposed between the head of the seat component and an inner surface of the elongate quill body, and a hydraulically actuated valve and a biaser each positioned within the guide component; and the biaser being held in compression between the hydraulically actuated valve and the seat component, and the hydraulically actuated valve being movable in opposition to a biasing force of the biaser from a first position to a closed position at which the hydraulically actuated valve contacts the seat component to interrupt a flow of the pressurized fuel from the proximal accumulator segment to the distal injector supply segment.

2. The quill connector of claim 1 wherein the guide component is coaxial with the elongate quill body, and a clearance extends radially between the guide component and the elongate quill body.

3. The quill connector of claim 2 wherein the guide component defines a reset orifice in fluid communication with the clearance, and the reset orifice has a flow area less than a minimum flow area of the clearance.

4. The quill connector of claim 2 wherein the seat component further includes a valve seating surface contacted by the hydraulically actuated valve when the hydraulically actuated valve is located in the closed position, and the neck is interference fitted within the distal injector supply segment of the elongate quill body.

5. The quill connector of claim 4 further comprising an edge filter positioned within the distal injector supply segment between the neck and the fuel outlet.

6. The quill connector of claim 4 wherein the distal body end includes a distal tip having a spherical sealing surface extending circumferentially around the fuel outlet.

7. The quill connector of claim 2 wherein the hydraulically actuated valve is movable in a distal direction from the first position to the closed position, and the flow limiter subassembly further includes a stop component coupled to the guide component and limiting travel of the hydraulically actuated valve in a proximal direction past the first position.

8. The quill connector of claim 7 wherein the hydraulically actuated valve includes a cup-shaped valve body having a circular base coaxial with the elongate quill body, and a cylindrical skirt extending from the circular base in a distal direction within the guide component, and wherein the biaser includes a biasing spring positioned partially within the cylindrical skirt and contacting each of the circular base and the seat component.

9. A fuel system for an internal combustion engine comprising:

a supply of pressurized fuel;

a fuel feed line in fluid communication with the supply of pressurized fuel;

a fuel injector defining a high pressure fuel inlet, and a nozzle outlet, and having an injection valve movable between a first position at which the injection valve blocks the nozzle outlet from the high pressure fuel inlet, and a second position at which the nozzle outlet is open;

a quill connector including a proximal end having a quill inlet formed therein and in fluid communication with the fuel feed line, and a distal end having a quill outlet formed therein, and the distal end being in sealing engagement with the fuel injector, such that the quill outlet is in fluid communication with the high pressure fuel inlet;

the quill connector including an elongate quill body defining a fuel conduit fluidly connecting the quill inlet with the quill outlet, the fuel conduit including a proximal accumulator segment and a distal injector supply segment, a volume of the proximal accumulator segment being greater than a volume of the distal injector supply segment, the proximal accumulator segment defining a longitudinal axis therein extending from the quill inlet toward the quill outlet;

the quill connector further including a flow limiter subassembly including a guide component disposed within the proximal accumulator segment, a seat component including a head captive within the guide component and a neck extending in a distal direction from the head into the distal injector supply segment, wherein the seat component is attached to the elongate quill body and supporting the guide component in fixed relation to the elongate quill body along the longitudinal axis and wherein a distal end of the guide component is disposed between the head of the seat component and an inner surface of the elongate quill body, and a hydraulically actuated valve and a biaser each positioned within the guide component; and the biaser being held in compression between the hydraulically actuated valve and the seat component, and the hydraulically actuated valve being movable in opposition to a biasing force of the biaser from a first position to a closed position at which the hydraulically actuated valve contacts the seat component to interrupt a flow of the pressurized fuel from the quill connector to the fuel injector.

10. The fuel system of claim 9 wherein the quill connector includes an inner surface defining the fuel conduit, and the seat component is interference fitted with the inner surface within the distal injector supply segment.

11. The fuel system of claim 10 wherein the hydraulically actuated valve is movable in a distal direction from the first position to the closed position, and the flow limiter subassembly further includes a stop component coupled to the guide component and limiting travel of the hydraulically actuated valve in a proximal direction past the first position.

12. The fuel system of claim 11 wherein the guide component defines a reset orifice.

13. The fuel system of claim 12 wherein a clearance extends between the guide component and the inner surface of the quill connector and is in fluid communication with the reset orifice.

14. The fuel system of claim 9 wherein an inner diameter dimension of the proximal accumulator segment is greater than an inner diameter dimension of the distal injector supply segment.

15. The fuel system of claim 14 wherein the quill connector further includes an inlet body defining an inlet passage fluidly connecting the fuel feed line to the quill inlet, and wherein an inner diameter dimension of the fuel feed line is less than the inner diameter dimension of the proximal accumulator segment.

16. The fuel system of claim 15 wherein the quill connector is one of a plurality of quill connectors, and the fuel injector is one of a plurality of fuel injectors each fluidly connected with a fuel conduit of one of the plurality of quill connectors, and wherein the fuel system further includes a second fuel feed line, and the inlet body defines an outlet passage fluidly connecting the inlet passage with the second fuel feed line.

17. A method for limiting oversupplying a pressurized fuel from a quill connector to a fuel injector in an internal combustion engine comprising the steps of:

conveying a pressurized fuel from an accumulator segment to an injector supply segment of a fuel conduit in the quill connector, a volume of the accumulator segment being greater that a volume of the injector supply segment;

supplying the pressurized fuel from the injector supply segment to the fuel injector;

hydraulically actuating a valve in a flow limiter subassembly of the quill connector during the supplying of the pressurized fuel, such that the valve moves along a longitudinal axis toward a closed position contacting a seat component of the flow limiter subassembly;

guiding the valve during the actuation within a guide component of the flow limiter subassembly, the guide component being supported within the accumulator segment in fixed relation to the quill connector along the longitudinal axis; and blocking fluid communication between the accumulator segment and the injector supply segment via contacting the valve with the seat component at the closed position, such that the supplying of the pressurized fuel to the fuel injector is interrupted, wherein supporting the guide component includes disposing a distal end of the guide component between a head end of the seat component captive within the guide component and an inner surface of the elongate quill body and wherein supporting the guide component further includes interference fitting a neck of the seat component within the injector supply segment.

18. The method of claim 17 wherein the step of hydraulically actuating further includes moving the valve toward the closed position in opposition to a bias of a biaser held in compression between the valve and the seat component.

19. The method of claim 18 wherein the step of hydraulically actuating further includes moving the valve in a distal direction toward the closed position, and further comprising a step of resetting the valve at least in part by conveying pressurized fuel to a distal side of the valve via a reset orifice defined by the guide component.

* * * * *